US006017370A

United States Patent [19]

Manka et al.

[11] Patent Number: 6,017,370

[45] Date of Patent: Jan. 25, 2000

[54] FUMARATE COPOLYMERS AND ACYLATED ALKANOLAMINES AS LOW TEMPERATURE FLOW IMPROVERS

[75] Inventors: John S. Manka, Euclid; Kim L. Ziegler, Eastlake, both of Ohio; Daniel R. Nelson, Manhattan Beach, Calif.

[73] Assignee: The Lubrizol Corporation, Wickliffe, Ohio

[21] Appl. No.: 09/161,125

[22] Filed: Sep. 25, 1998

[51] Int. Cl.[7] ..... C10L 1/18

[52] U.S. Cl. ..... 44/397; 44/393; 44/395; 44/405; 44/418; 508/467; 508/475

[58] Field of Search ..... 44/393, 394, 397, 44/418, 395, 405, 408; 508/467, 475

[56] References Cited

U.S. PATENT DOCUMENTS

| | | | |
|---|---|---|---|
| 3,136,743 | 6/1964 | Conway et al. | 260/78.5 |
| 3,341,309 | 9/1967 | Ilnyckyj | 44/62 |
| 3,413,103 | 11/1968 | Young et al. | 44/62 |
| 3,658,493 | 4/1972 | Hollyday | 44/394 |
| 4,234,435 | 11/1980 | Meinhardt et al. | 252/51.5 A |
| 4,261,703 | 4/1981 | Tack et al. | 44/62 |
| 4,661,121 | 4/1987 | Lewtas | 44/70 |
| 4,661,122 | 4/1987 | Lewtas | 44/70 |
| 4,713,088 | 12/1987 | Tack et al. | 44/394 |
| 4,772,674 | 9/1988 | Shih et al. | 526/325 |
| 4,863,486 | 9/1989 | Tack et al. | 44/394 |
| 4,885,008 | 12/1989 | Ishizaki et al. | 44/394 |
| 5,045,088 | 9/1991 | More et al. | 44/393 |
| 5,330,545 | 7/1994 | Lewtas et al. | 44/395 |
| 5,503,645 | 4/1996 | Jung et al. | 44/418 |
| 5,725,610 | 3/1998 | Vassilakis et al. | 44/331 |

*Primary Examiner*—D. Gabrielle Brouillette
*Assistant Examiner*—Cephia D. Toomer
*Attorney, Agent, or Firm*—David M. Shold

[57] ABSTRACT

The low temperature flow properties of wax-containing liquids are improved by adding a composition comprising (i) a polymer of a $C_{8-20}$ alkyl ester of an ethyleneically unsaturated 1,2-diacid, and (ii) the reaction product of an alkanolamine with a $C_{8-50}$ hydrocarbyl-substituted acylating agent.

26 Claims, No Drawings

FUMARATE COPOLYMERS AND ACYLATED ALKANOLAMINES AS LOW TEMPERATURE FLOW IMPROVERS

BACKGROUND OF THE INVENTION

The present invention relates to low temperature flow improvers for wax-containing liquids.

Low temperature properties of wax-containing liquids, especially hydro-carbon-based liquids are important. When diesel fuels, home heating oils, various oils of lubricating viscosity, automatic transmission fluids, hydraulic fluids, crude oils, and other paraffinic liquids are cooled, solidification occurs progressively, normally over a range spanning some 10 to 15° C. This solidification is generally undesirable for materials which are normally handled in the liquid state, and efforts to measure and ameliorate this phenomenon have been pursued. Cloud point is the measurement of the temperature at which paraffin crystals first appear when such a material is cooled. This value is determined by standardized methods such as ASTM D 2500. At temperatures below the cloud point, the material becomes increasingly solid, until the pour point (ASTM D 97) is reached, that is, the temperature at which the material has essentially solidified. Another test by which the low temperature properties is evaluated is the cold filter plugging point (CFPP) test, IP 309/80. Another test, commonly used in refineries, is the low temperature flow test (LTFT), ASTM D 4539-91, which simulates the slow cooling and filtration of diesel fuel through a fuel system at low temperatures.

Such wax-containing hydrocarbon materials often require the use of pour point depressant additives in order to allow them to flow freely at lower temperatures. Often kerosene is included in such oils as a solvent for the wax, particularly that present in distillate fuel oils. However, demands for kerosene for use in jet fuel has caused the amount of kerosene present in distillate fuel oils to be decreased over the years. This, in turn, has required the addition of wax crystal modifiers to make up for the lack of kerosene. Moreover, the requirement for pour point depressant additives in crude oils can be even more important, since addition of kerosene is not considered to be economically desirable. The use of kerosene as an additive for fuels, moreover, can be undesirable since it can lead to a higher flash point.

There have been many approached to modifying the low temperature properties of hydrocarbon fluids. U.S. Pat. No. 2,936,300, Tutwiler et al., May 10, 1960, discloses copolymers of vinyl acetate and dialkyl fumarate, useful for improving the pour point and viscosity index of oils.

U.S. Pat. No. 4,234,435, Meinhardt et al., Nov. 18, 1980, discloses carboxylic acid acylating agents derived from polyalkenes and a dibasic carboxylic reactant such as maleic or fumaric acid. The acylating agents can be reacted with a further reactant subject to being acylated, such as polyethylene polyamines.

U.S. Pat. No. 4,661,121, Lewtas, Apr. 28, 1987, discloses middle distillate compositions with improved low temperature properties, by addition of a polymer or copolymer of a n-alkyl vinyl or fumarate ester with n-alkyl groups of 14–18 carbon atoms. Copolymers of di-n-alkyl fumarates and vinyl acetate are preferred. Coadditives which may be present include polar nitrogen containing compounds; these are generally the $C_{30}$–$C_{300}$ amine salts and/or amides formed by reaction of hydrocarbyl substituted amines with hydrocarbyl acids having 1–4 carboxylic groups. In an example, such a compound is the reaction product of phthalic anhydride with di-hydrogenated tallow amine.

U.S. Pat. No. 5,725,610, Vassilakis et al., Mar. 10, 1998, discloses an additive composition which comprises a combination of (i) the reaction product of an aliphatic compound of e.g. alkyl (10–32 C) maleic anhydride and a polyamine and (ii) the reaction product of (A) esterification of a saturated linear alcohol of 6 to 24 carbon atoms with acrylic acid or halide and (B) polymerization of the ester of (A) with itself or maleic, alkylmaleic, or alkenylsuccinic anhydride, acrylic acid, or fumaric acid, or esters thereof. The polyamine of (i) is of the general formula

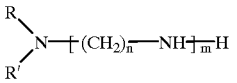

where R is a saturated aliphatic radical and R' is hydrogen or a saturated aliphatic radical (each of 1–32 carbon atoms). n is 2 to 4 and m is 1 to 4.

SUMMARY OF THE INVENTION

The present invention provides a method for improving the low temperature flow properties of a wax-containing liquid composition which comprises a wax-containing liquid; comprising adding to said liquid an amount, sufficient to improve the low temperature flow properties of said wax-containing liquid, of a composition comprising (i) a polymer comprising at least one monomer of at least one alkyl ester of an ethyleneically unsaturated 1,2-diacid, wherein the alkyl groups of said ester contain on average about 8 to about 30 carbon atoms and (ii) the reaction product of an alkanolamine with a hydrocarbyl-substituted acylating agent, wherein the hydrocarbyl group is substantially linear and contains on average about 8 to about 50 carbon atoms.

The present invention further provides a wax-containing liquid composition comprising: (a) a wax-containing liquid which exhibits diminished flow properties at low temperatures; and (b) an amount, sufficient to improve the low temperature flow properties of said wax-containing liquid, of a composition comprising (i) a polymer comprising at least one monomer of at least one alkyl ester of an ethyleneically unsaturated 1,2-diacid, wherein the alkyl groups of said ester contain on average about 8 to about 30 carbon atoms and (ii) the reaction product of an alkanolamine with a hydrocarbyl-substituted acylating agent, wherein the hydrocarbyl group is substantially linear and contains on average about 8 to about 50 carbon atoms.

DETAILED DESCRIPTION OF THE INVENTION

Various preferred features and embodiments will be described below by way of non-limiting illustration.

The first component of the present invention, which will normally be the major component, is a wax-containing liquid which exhibits diminished flow properties at low temperatures. "Wax" is generally considered to comprise linear paraffins having as low as 10 carbon atoms and up to 40 carbon atoms or more, i.e., up to perhaps 60 carbon atoms. The presence of wax becomes troublesome when it is occurs in amounts which lead to thickening upon cooling, typically amounts in the range of 0.25 to 60 percent by weight, more commonly 1 to 50 percent by weight, and most commonly 1 to 15 percent by weight of the wax-containing liquid. Examples of wax-containing liquids include distillate fuels including middle distillate fuels, diesel fuels, home heating oils; various oils of lubricating viscosity including formulated oils such as engine lubricants, automatic transmission fluids, and hydraulic fluids; and other paraffinic liquids including crude oils and petroleum streams derived from crude oils, including residual oil, vacuum gas oil, or vacuum residual oils (Bunker C crude oils); that is, naturally sourced and partially refined oils, including partially processed petroleum derived oils. In addition to petroleum-derived liquids, the first component of the present invention can be a synthetic liquid or a vegetable-oil derived liquid, provided, of course, that they contain wax and exhibit diminished flow properties at low temperatures. The fluid can contain sulfur at various levels or, preferably, can be low sulfur materials, such as low sulfur fuels containing less than 0.05% by weight of sulfur, for example 0.01% by weight or less.

Middle distillates are petroleum distillates which typically represent a cut distilled between 150° C. and 450° C.; an example is diesel fuel, described in ASTM D-975, which is typically a cut distilled between 190° C. and 350° C. Various grades typically exhibit a 90% distillation temperature in the range of 282° C. to 338° C. The additives of the present invention are particularly useful for treating middle distillate fuels which exhibit a cloud point (in the absence of treatment) of at least −40° C., for example, −35° C. or higher, preferably −25° C. or higher.

The wax-containing liquid is treated with an additive composition, comprising two components. The first component of the additive is a polymer comprising at least one monomer of a least one alkyl ester of an ethylenically unsaturated 1,2-diacid, wherein the alkyl groups of the ester contain on average 8 to 30 carbon atoms. This material is a polymer which has a substantially carbon chain backbone derivable from the addition polymerization of an ethylenically unsaturated diacid, optionally with other comonomers, described below. The polymerized acid groups are at least partly and preferably substantially completely in the form of alkyl esters; reference herein to polymerization of acids is not intended to be limiting to the use of the actual acid in the polymerization reaction, but encompasses polymerization of esters and other materials which can be converted into esters, including anhydrides and acid halides.

The diacids which are capable of polymerization are generally those ethylenically unsaturated acids having 3 to 6 carbon atoms, including those with α,β-ethylenic unsaturation. Specific materials include fumaric acid, maleic acid, itaconic acid, and citraconic acid and their reactive equivalents. Among these diacids, fumaric acid is preferred; the corresponding dialkyl ester is a dialkyl fumarate. It is understood that maleic acid and fumaric acid become substantially equivalent after they are polymerized, since their double bond becomes a single bond during the polymerization reaction. However, details of the stereochemistry of the resulting polymer may in some cases differ depending on whether maleic (cis) or fumaric (trans) monomer is used. In some instances it may be more convenient to use one material rather than the other; maleic acid, for example, can form a cyclic anhydride which can be polymerized as such, while fumaric acid cannot. Generally, however, references herein to polymers of fumaric acid or fumaric esters are intended to include polymers similarly derived from maleic acid, maleic anhydride, or maleic esters.

The polymer can be prepared directly from the ester of the acid, or it can be prepared from the acid itself or (in the case of certain diacids) the anhydride, or from other reactive monomers. If the polymer is prepared from one of the materials other than the ester it can be converted into the ester form by reaction of the polymer with a suitable alcohol or by other well-known reactions.

The alcohol with which the acid monomer or the polymeric acid functionally or equivalent thereof is reacted to form the ester is an alcohol with an alkyl chain containing 8 to 30 carbon atoms, preferably 10 to 28 carbon atoms, and more preferably 12 to 22 carbon atoms. The alkyl group need not be derived from a single alcohol of a single chain length, however, but can be derived from a mixture of alcohols if desired, provided that at least on average the chain lengths of the alcohol portion fall within the desired range. Moreover, the specific chain length of the alkyl groups can be selected to correspond to the type of fluid in which the polymer is employed, in order to optimize the effectiveness for the particular fluid.

The polymer of component (b)(i) can also contain other monomers derived from ethylenically unsaturated compounds. These comonomers can be short chain ester-containing monomers. Examples of short chain ester-containing monomers include vinyl alkanoates where the alkanoate moiety contains up to 8 carbon atoms and preferably up to 4 carbon atoms, such as vinyl acetate, vinyl propionate, and vinyl butyrate. Other examples are short chain esters of unsaturated acids, having fewer than 8 carbon atoms, and preferably up to 4 carbon atoms in the alcohol-derived moiety. Such short chain esters include methyl acrylate, methyl methacrylate, ethyl acrylate, ethyl methacrylate, propyl acrylate or methacrylate, and n-butyl, t-butyl, and isobutyl acrylate or methacrylate. Alternatively, or additionally, the polymer can contain short chain alkyl ether comonomers, where the alkyl group has up to 8 carbon atoms and preferably up to 4 carbon atoms. Examples are vinyl ether groups such as the alkyl vinyl ethers, e.g., ethyl vinyl ether, propyl vinyl ether, and the butyl vinyl ethers.

The preferred comonomer is vinyl acetate, and the preferred copolymer is a copolymer with an alkyl fumarate, preferably a dialkyl fumarate, with vinyl acetate. The mole ratio of alkyl fumarate and vinyl acetate can range from 1:2 upwards to 100 mole percent alkyl fumarate (that is, a homopolymer); typically mole ratios are 1:2 to 2:1, preferably 0.9:1 to 1:0.9.

The polymer of component (b)(i) can also contain other copolymerizable monomers such as the α-olefins, including ethylene, propylene, or styrene, as well as carbon monoxide or sulfur dioxide. The amount of these and other supplemental comonomers, if any, is preferably sufficiently low that the polymer substantially retains its character as a hydrocarbyl alkenoate polymer, modified by the presence of the above-defined comonomer.

The polymers of component (b) can be prepared by known methods. In one case di-($C_{12}$–$C_{14}$) fumarate is mixed with an appropriate amount of vinyl acetate. The polymerization is carried out by mixing and heating the reactants with or without a solvent or diluent in the presence of a small amount of an initiator at a temperature of from 25° C. to 150° C., preferably up to 100° C. Since the polymerization is exothermic, cooling may be required to maintain the reaction mixture at the desired temperature. It is often convenient to add one of the reactants to the other reactant or reactants over a period of time in order to control the rate of the reaction.

The polymerization can be carried out in the presence of a small amount of an initiator such as an organic peroxide or azo-bis-isobutyronitrile. Organic peroxides such as benzoyl peroxide are especially useful. Generally 0.01 to 1.5% of the initiator is used.

The reaction time can vary from 1 to 30 hours depending on the temperature, reactivity of the monomers, and other reaction conditions. The polymerization can be run continuously or batchwise. Details of such polymerizations are well known to those skilled in the art and are reported in greater detail in U.S. Pat. No. 3,250,715.

The molecular weight of the resulting polymer will depend on a variety of factors under the control of the skilled operator, including concentrations of monomers and catalyst. The polymer of the present invention ordinarily has a number average molecular weight of 2,000 to 100,000, generally 5,000 to 50,000, preferably 10,000 to 45,000.

The second component of the additive, (b)(ii), is the reaction product of an alkanolamine with a hydrocarbyl-substituted acylating agent, wherein the hydrocarbyl group is substantially linear and contains on average about 8 to about 50 carbon atoms.

The hydrocarbyl-substituted acylating agent (i) comprises mono-carboxylic acid acylating agents, poly-carboxylic acid acylating agents as well as dimer acids, trimer acids, or mixtures thereof. The mono-carboxylic acid acylating agents are of the formula $R^7COOH$ wherein $R^7$ is a substantially linear hydrocarbyl group typically containing 8 to 50 carbon atoms; alternatively, $R^7$ can be a group comprising an aromatic portion which is substituted by a substanially linear aliphatic hydrocarbyl group containing 8 to 50 carbon atoms. Preferably the hydrocarbyl group is an aliphatic group comprising an alkyl group or an alkenyl group and contains 8 to 23 or 13 to 19 carbon atoms. Useful monocarboxylic acids are the substantially linear isomeric acids of octanoic acid, nonanoic acid, decanoic acid, undecanoic acid and dodecanoic acid. Also useful are myristic acid, palmitic acid, stearic acid, oleic acid, linoleic acid and linolenic acid. Mixed acids as derived by hydrolysis of animal fats and vegetable oils also have utility.

Poly-carboxylic acid acylating agent include dicarboxylic acid acylating agents or dicarboxylic acid anhydride acylating agents of formulas I and II respectively

I

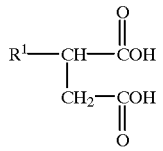

II

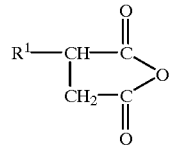

In the above formulas, $R^1$ is a substantially linear hydrocarbyl substituent typically having 8 to 50 carbon atoms.

Polycarboxylic acid acylating agents also include dimer acid acylating agents, trimer acid acylating agents and mixtures thereof. Dimer acylating agents are the products resulting from the dimerization of unsaturated fatty acids. Generally, the dimer acylating agents have an average of 18, preferably 28 to 44, preferably to 40 carbon atoms. In one embodiment, the dimer acylating agents have preferably about 36 carbon atoms. Dimer acylating agents are preferably prepared from fatty acids, which generally contain 8, preferably 10, more preferably 12 to 30, preferably to 24 carbon atoms. Examples of fatty acids include oleic, linoleic, linolenic, tall oil, and resin acids, preferably oleic acid, e.g., the above-described fatty acids. Examples of dimer acylating agents include Empol® 1043 and 1045 Dimer Acid, available from Emery Industries, Inc. and Hystrene® Dimer Acids 3675, 3680, 3687 and 3695, available from Humko Chemical. Trimer acid acylating agents are prepared by reacting a dimer acid acylating agent with an unsaturated fatty acid. Those materials which contain a substantially linear hydrocarbyl chain are preferred.

Poly-carboxylic acid acylating agents are likewise well known to those skilled in the art. Polycarboxylic acid acylating agents are generally prepared by reacting an olefin polymer or chlorinated analog thereof with an unsaturated carboxylic acid or derivative thereof such as acrylic acid, fumaric acid, maleic anhydride and the like. Typically, polycarboxylic acid acylating agents are succinic acid acylating agents derived from maleic acid, its isomers, anhydride, and chloro and bromo derivatives thereof.

These acylating agents have at least one substantially linear hydrocarbyl-based substituent $R^1$. Generally, $R^1$ has an average of at least 8, and often at least 18 carbon atoms. Typically, $R^1$ has a maximum average of 50 and often 36 carbon atoms. Generally, the hydrocarbon-based substituent $R^1$ is free from acetylenic unsaturation; ethylenic unsaturation, when present will generally be such that there is not more than one ethylenic linkage present for every ten carbon-to-carbon bonds in the substituent. The substituents may be completely saturated or contain ethylenic unsaturation.

The hydrocarbyl chains are preferred to be substantially linear in order that they may effectively interact with the substantially linear chains of paraffin waxes which can be found as components of wax-containing liquids. While not intending to be bound by any theory, it is believed that the greater the degree of linearity of the hydrocarbyl groups, the greater will be the interaction with the wax and the more effectively will the materials serve in the present invention. For most effective interaction, a completely linear carbon chain is preferred. Relatively small amounts of branching in the hydrocarbon chain are permitted within the scope of the meaning "substantially linear." For example, it is preferred that there be not more than one branch in the chain per 10 carbon atoms, and more preferably not more than one per 20 carbon atoms. Otherwise expressed, the number of carbon atoms in branches should preferably be no more than 10 or 15 percent of the total number of carbon atoms in the hydrocarbly group, preferably no more than 5 percent, and more preferably no more than 2 percent. It is noted that the length of the branches can also play a role. The presence of an occasional methyl group branch may be more acceptable than ethyl branches, which in turn may be more acceptable that longer chain branches. It is also possible that an initial portion of the hydrocarbyl chain may be relatively highly branched or may contain alicyclic, heterocyclic, or aromatic rings, but that initial portion may be followed by or substituted by a relatively longer portion of linear, unbranched carbon chain. In such a case, if the longer unbranched portion predominates, the composition as a whole can be suitable and the material can be considered to be "substantially unbranched" for purposes of the present invention. Most specifically, it is believed that at times the reaction of an (α-olefin with an acid such as fumaric acid can lead to addition to the β carbon of the olefin and the presence of a methyl branch at the point of attachment. This minor degree of branching is specifically intended to be encompassed within the use of the term "substantially linear."

As noted above, the hydrocarbon-based substituent $R^1$ present in the polycarboxylic acid acylating agents of this invention are derived from olefin polymers or chlorinated analogs thereof. In such a case the polymeric portion should retain its substantially linear character. Accordingly, it is preferred that such a polymer be derived principally from polymerization of ethylene, in order to avoid extensive branching which could result if a large portion of higher olefins were incorporated into the polymer. Specific examples of terminal and medial olefin monomers which can be used in appropriately low amounts to prepare the olefin polymers from which the hydrocarbon based substituents in the acylating agents used in this invention are ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3 isoprene, hexadiene-1,5, 2-chloro-butadiene-1,3, 2-methylheptene-1,3-cyclohexylbutene-1,3,3-dimethylpentene-1, styrene, divinylbenzene, vinylacetate, allyl alcohol, 1-methylvinylacetate, acrylonitrile, ethylacrylate, ethylvinylether and methylvinyl-ketone.

The substantially linear hydrocarbyl group can be derived from one or more olefins having on average 8 to 50 carbon atoms, preferably 12 to 36 carbon atoms, and more preferably 16 to 24 carbon atoms, or about 18 carbon atoms. These olefins are preferably alpha-olefins (sometimes referred to as mono-1-olefins) or isomerized alpha olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, and 1-tetracosene. Commercially available alpha-olefin fractions that can be used include the $C_{15-18}$ alpha olefins, $C_{12-16}$ alpha-olefins, $C_{14-16}$ alpha-olefins, $C_{14-18}$ alpha olefins, $C_{16-18}$ alpha olefins, $C_{16-20}$ alpha-olefins, and $C_{22-28}$ alpha olefins. The $C_{16}$ and $C_{16-18}$ alpha olefins are particularly preferred. Mixtures of these materials can also be used, as well as mixtures of these materials with relatively small amounts of olefins outside the desired range of carbon number, provided that the mixture on average comprises olefins of 8 to 50 carbon atoms. The average referred to is number average.

Isomerized alpha-olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those skilled in the art. Briefly, these procedures can involve contacting alpha-olefin with a cation exchange resin at a temperature of 80° C. to 130° C. until the desired degree of isomerization is achieved. These procedures are described for example in U.S. Pat. No. 4,108,899.

Succinic acylating agents can be prepared by reacting the above-described olefins or mixtures of olefins with unsaturated carboxylic acids such as fumaric acids or maleic acid or anhydride at a temperature of 160° C. to 240° C., preferably 185° C. to 210° C. Free radical inhibitors such as t-butyl catechol can be used to reduce or prevent the formation of polymeric byproducts. The procedures for preparing the acylating agents are well known to those skilled in the art and have been described, for example, in U.S. Pat. No. 3,412,111.

As noted above, typical polycarboxylic acid acylating agents are substituted succinic acids or derivatives thereof. In this case, the preferred polycarboxylic acid acylating agent can be represented by the formulas, wherein the hydrocarbyl substituent is designated by "hyd":

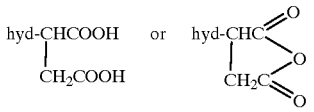

The dicarboxylic acid acylating agents or dicarboxylic acid anhydride acylating agents can also be represented by the formulas

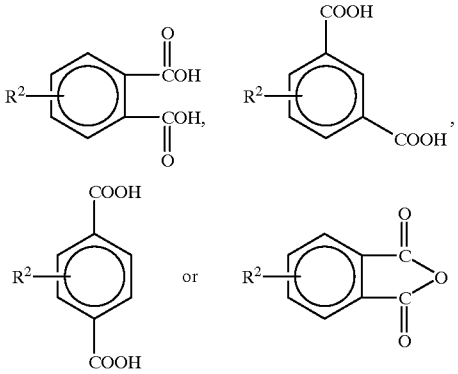

wherein $R^2$ is a hydrogen atom or an aliphatic group containing 8 to 36 carbon atoms. One mixture of acylating agents comprises a mixture of phthalic acid and maleic anhydride in a mole ratio of one mole of phthalic acid per three moles of maleic anhydride.

The nitrogen containing compound with which the acylating agent reacts consists of a hydroxyamine, which can be represented by the formula

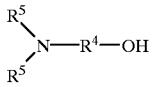

wherein $R^4$ is a divalent hydrocarbyl group typically containing 2 to 18 carbon atoms and each $R^5$ is independently hydrogen, an aliphatic group containing 1 to 8 carbon atoms or a hydroxyalkyl group containing 1 to 5 carbon atoms. When $R^5$ is an aliphatic group, preferably the aliphatic group contains 1 to 6 carbon atoms and most preferably 1 to 4 carbon atoms. When $R^5$ is a hydroxy alkyl group, preferably the alkyl group thereof contains 1 to 3 carbon atoms and most preferably 1 or 2 carbon atoms.

Preferably the $R^4$ group is a 1,2- or 1,3-alkylene group. That is, at most there are only two or three carbon atoms between the nitrogen and the hydroxyl group. Preferred $R^4$ groups are ethylene; 1,2-propylene; 1,2-butylene; 1,3-butylene, 1,2-pentylene, 1,2-hexylene; 1,2-heptylene; 1,2-octylene; 1,2-nonylene; 1,2-decylene; 1,2-dodecylene; 1,2-hexadecylene or 1,2-octadecylene. Most preferably $R^4$ is ethylene. Further, the 1,2-alkylene group preferably generates a hydroxyamine with a primary OH rather than a secondary OH. That is, when $R^4$ is a 1,2-propylene, the substitution is such that the hydroxyamine has the structure $H_2NC(CH_3)CH_2OH$ rather than $H_2NCH_2CH(CH_3)OH$.

Hydroxyamines, also known as alkanol amines, include primary, secondary or tertiary alkanol amines or mixtures thereof. Primary alkanol amines arise when both of the $R^5$ groups are hydrogen. Preferably, the primary alkanol amine is monoethanolamine. When one $R^5$ is hydrogen and the other $R^5$ is either an aliphatic group or hydroxy alkyl group, the hydroxyamine is a secondary alkanol amine. Preferred $R^5$ alkyl groups are methyl and ethyl to give the preferred N-methyl-N-ethanolamine and N-ethyl-N-ethanolamine. When both $R^5$ groups are either independently an aliphatic group or a hydroxy alkyl group, the hydroxyamine is a tertiary alkanolamine.

In forming the additive component (b)(ii), the hydrocarbyl-substituted acylating agent and the hydroxyamine are reacted together at temperatures of from ambient up to the decomposition temperature of any reactant or product. The molar ratio of (i):(ii) is 0.5–6:3, preferably 1.5–4.5:3 and more preferably about 1:1. When the molar ratio is 1:1, the product so formed is a polymeric product typically having ester, amide and salt functionalities.

Since the additive component (b)(ii) is the reaction product of a carboxylic acylating agent (i) with a hydroxyamine, a variety of possible materials can be formed from these reactants. The hydroxyamine reacts with the carboxylic acylating agent either as an amine or an alcohol. There are three basic types of reactions which a carboxylic acylating agent as a succinic acylating of formula I and II above can undergo with an amine. The first reaction is simple salt formation. In this reaction, the amine acts as a base and accepts a proton from the carboxylic acid. All ordinary amines can undergo this reaction.

Another reaction which a hydroxyamine as an amine can undergo with a succinic acylating agent is the formation of an amide. In this reaction the hydroxyamine condenses with a single carboxyl group eliminating a molecular of water. Only primary and secondary hydroxyamines can undergo amide formation.

A third reaction of hydroxyamines as an amine with succinic acylating agents is imide formation. In this reaction an amine condenses with two carboxyl groups with the elimination of two molecules of water (or reacts with an anhydride with elimination of one molecule of water). Only primary hydroxyamines can undergo imide formation.

Salts form under relatively mild conditions, while the formation of amides and imides generally requires higher temperatures and longer reaction times.

The hydroxyamine can also function as an alcohol. The basic reaction between a hydroxyamine as an alcohol and a succinic acylating agent is ester formation.

It is to be understood that if the acylating agent contains a plurality of acid functionality, not all the acid groups will necessarily have reacted to form the esters, amides, imides, or salts. Thus the product can be a half ester, half amide, and so on.

The following examples are illustrative of the preparation of component (b)(ii) of the present invention. Unless otherwise indicated, all parts and percentages are by weight.

EXAMPLE B-1

Charged to a reaction vessel is 47 parts (0.11 moles) of a $C_{18-24}$ substituted succinic anhydride and 16 parts (0.207 moles) of the tertiary alkanolamine triethanolamine. After an initial exotherm, the mixture is slowly heated to 150° C. with nitrogen blowing at 0.25 cubic feet per hour. The contents are stirred for two hours. The liquid is the product having a total acid number (TAN) of 20.8 and a total base number (TBN) of 91.6.

EXAMPLE B-2

The procedure of Example B-3 is essentially repeated except that 127.4 parts (0.29 moles) of the substituted succinic anhydride of Example B-1 is used along with 30.4 parts (0.29 moles) of the secondary alkanolamine diethanolamine. The product has a percent nitrogen of 2.57, a TAN of 32.6 and a TBN of 28.

EXAMPLE B-3

Added to a reaction vessel are 172 parts (1.0 mole) capric acid and 61 parts (1.0 mole) of monoethanolamine. The contents are heated to 150° C. and held for 3.0 hours. The liquid is the product.

In the compositions of the present invention, components (i) and (ii) are present amounts sufficient to improve the low temperature flow properties of the wax-containing liquid. More specifically, the amount of component (b) is typically that amount which is sufficient to reduce the cloud point of the liquid by at least 0.5° C., and preferably by at least about 1° C., as measured by ASTM D2500. A preferred amount of component (b) is, similarly, an amount sufficient to improve the low temperature flow of the liquid by at least 0.5° C., and preferably at least 1° C. as measured by ASTM D4539-91. The total amount component (b) in the composition is preferably 5 to 10,000 parts per million by weight, preferably 25 to 2000 parts per million, and more preferably 100 to 1000 or 200 to 800 parts per million. Generally components (i) and (ii) will be present in the ratio of (i):(ii) of 1:10 to 10:1 by weight, preferably 1:4 to 4:1 by weight, and more preferably about 1:1 by weight.

Components (i) and (ii) can also be added separately to a variety of materials, including fuels of various sulfur levels, including low sulfur fuels, to provide a measure of improvement in low temperature properties. However, the compositions in which only a single component are used are not as beneficial as those in which both components are used, preferably in the above amounts.

The combination of the present additives with certain supplemental materials such as pour point depressants exhibit especially superior low temperature properties. Materials which are useful as pour point depressants are well known and include such materials as alkyl acrylate polymers, alkyl methacrylate polymers, esters of olefin-maleic anhydride polymers (including esters of ethylene/maleic anhydride copolymers and styrene/maleic anhydride copolymers), and in particular ethylene vinyl acetate (EVA) copolymers.

EVA copolymers (optional component (c)) are well known materials, typically made by free-radical polymerization of vinyl acetate and ethylene, optionally with other comonomers. Preferred materials for use in the present invention are binary copolymers which contain 15 to 40 weight percent, and more preferably 33 to 38 weight percent copolymerized vinyl acetate. The number average molecular weight of the supplemental polymeric pour point depressant is not particularly critical but for EVA copolymers is preferably 1000 to 10,000, more preferably 1500 to 2600.

If the copolymer of ethylene and vinyl acetate is used it will preferably be present in amounts of 5 to 2000 parts per million by weight, preferably 10 to 1000, and more preferably 50 to 200 parts per million.

Another optional component (d) is a pour point depressant comprising the reaction product of (i) a hydrocarbyl-substituted phenol and (i) an aldehyde of 1 to 12, preferably 1 to 4, carbon atoms, or a source therefor.

Hydrocarbyl-substituted phenols are known materials, as is their method of preparation. When the term "phenol" is used herein, it is to be understood that this term is not generally intended to limit the aromatic group of the phenol to benzene (unless the context so indicates), although benzene may be the preferred aromatic group. Thus, the aromatic group of a "phenol" can be mononuclear or polynuclear, substituted, and can include other types of aromatic groups as well.

The aromatic group of the hydroxyaromatic compound can thus be a single aromatic nucleus such as a benzene nucleus, a pyridine nucleus, a thiophene nucleus, a 1,2,3,4-tetrahydronaphthalene nucleus, or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups.

The hydrocarbyl phenol is a hydroxyaromatic compound, that is, a compound in which at least one hydroxy group is directly attached to an aromatic ring. The number of hydroxy groups per aromatic group will vary from 1 up to the maximum number of such groups that the hydrocarbyl-substituted aromatic moiety can accommodate while still retaining at least one, and preferably at least two, positions, at least some of which are preferably adjacent (ortho) to a hydroxy group, which are suitable for further reaction by condensation with aldehydes (described in detail below). Thus most of the molecules of the reactant will have at least two unsubstituted positions. Suitable materials can include, then, hydrocarbyl-substituted catechols, resorcinols, hydroquinones, and even pyrogallols and phloroglucinols. Most commonly each aromatic nucleus, however, will bear one hydroxyl group and, in the preferred case when a hydrocarbyl substituted phenol is employed, the material will contain one benzene nucleus and one hydroxyl group. Of course, a small fraction of the aromatic reactant molecules may contain zero hydroxyl substituents. For instance, a minor amount of non-hydroxy materials may be present as an impurity.

Preferably the hydrocarbyl group in component (d) is an alkyl group. The alkyl groups can be derived from either linear or branched olefin reactants; linear are sometimes preferred, although the longer chain length materials tend to have increasing proportions of branching. It is preferred that the hydrocarbyl substituent comprises at least 12 carbon atoms (number average), preferably a mixture of alkyl substituents having predominantly 16–28 carbon atoms and more preferably 24–28 carbon atoms; or, in an alternate form greater, than 30 carbon atoms, e.g., having on average 30 to 36 carbon atoms.

The second component which reacts to form optional component (d) is an aldehyde of 1 to 12 carbon atoms, or a source therefor. Suitable aldehydes have the general formula RC(O)H, where R is preferably hydrogen or a hydrocarbyl group, as described above, although R can include other functional groups which do not interfere with the condensation reaction of the aldehyde with the hydroxyaromatic compound. This aldehyde preferably contains 1 to 12 carbon atoms, more preferably 1 to 4 carbon atoms, and still more preferably 1 or 2 carbon atoms. Such aldehydes include formaldehyde, acetaldehyde, propionaldehyde, butyraldehyde, isobutyraldehyde, pentanaldehyde, caproaldehyde, benzaldehyde, and higher aldehydes. Monoaldehydes are preferred. The most preferred aldehyde is formaldehyde, which can be supplied as a solution, but is more commonly used in the polymeric form, as paraformaldehyde. Paraformaldehyde may be considered a reactive equivalent of, or a source for, an aldehyde. Other reactive equivalents may include hydrates or cyclic trimers of aldehydes.

The hydrocarbyl phenol and the aldehyde are generally reacted in relative amounts ranging from molar ratios of phenol:aldehyde of 2:1 to 1:1.5. Preferably approximately equal molar amounts will be employed up to a 30% molar excess of the aldehyde (calculated based on aldehyde monomer). Preferably the amount of the aldehyde is 5 to 20, more preferably 8 to 15, percent greater than the hydrocarbyl phenol on a molar basis. The components are reacted under conditions to lead to oligomer or polymer formation. The molecular weight of the product will depend on features including the equivalent ratios of the reactants, the temperature and time of the reaction, and the impurities present. The product can have from 2 to 100 aromatic units (i.e., the substituted aromatic phenol monomeric units) present ("repeating") in its chain, preferably 3 to 70 such units, more preferably 4 to 50, 30, or 14 units. When the hydrocarbyl phenol is specifically an alkyl phenol having 24–28 carbon atoms in the alkyl chain, and when the aldehyde is formaldehyde, the material will preferably have a number average molecular weight of 1,000 to 24,000, more preferably 2,000 to 18,000, still more preferably 3,000 to 6,000.

The hydrocarbyl phenol and the aldehyde are reacted by mixing the alkylphenol and the aldehyde in an appropriate amount of solvent and an acidic catalyst. The mixture is heated to remove water of condensation.

The product of this reaction can be generally regarded as comprising polymers or oligomers having the following repeating structure:

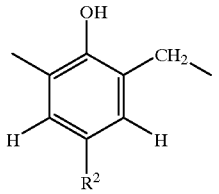

and positional isomers thereof. However, a portion of the formaldehyde which is preferably employed may be incorporated into the molecular structure in the form of substituent groups and linking groups including ether linkages and hydroxymethyl groups. Certain materials of component (d), their methods of preparation, and their structures are disclosed in British patent publication GB 2,305,437 A.

If component (d) is present in the compositions of the present invention, it will preferably by present at 5 to 1000 parts per million, more preferably 10 to 500 parts per million or 50 to 250 parts per million.

Other customary additives can also be present in the compositions of the present invention. When the composition is used as a fuel or a lubricant it can contain such materials as octane improvers, cetane improvers, antioxidants such as 2,6-di-tertiary-butyl-4-methylphenol, rust inhibitors such as alkylated succinic acids and anhydrides, bacteriostatic agents, gum inhibitors, metal deactivators, and dispersants such as esters of a mono- or polyol and a high molecular weight mono-or polycarboxylic acid acylating agent, especially those containing at least 30 carbon atoms in the acyl moiety. Other additives which can be present include detergents, antiwear agents, extreme pressure agents, emulsifiers, demulsifiers, friction modifiers, and dyes.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of Hydrocarbyl Groups Include (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Examples

Components of the present invention are added to a sample of commercial distilled diesel fuel. The alkyl fumarate/vinyl acetate polymer is a copolymer of di-$C_{12-22}$ alkyl fumarate and vinyl acetate in approximately a 1:1 mole ratio, number average molecular weight approximately 45,000. The copolymer is added as a 70% solution of polymer in hydrocarbon solvent. The acylated alkanolamine is the reaction product of diethanolamine with $C_{19-24}$ alkyl-substitued succinic anhydride, carbonyl:nitrogen ratio 2:1. The acylated alkanolamine is added as a 55% solution of chemical in hydrocarbon solvent. The total amounts of each component are presented in Table I without correction for the amount of solvent or the percentage of active chemical. The cloud point (ASTM D 2500) and minimum low temperature flow test pass value (ASTM D 4539-91) are reported for each composition, in Table I.

TABLE I

| Example | Fumarate copolymer, ppm | Acylated alkanol-amine, ppm | Other, ppm | Cloud point, ° C. | Minimum LTFT pass, ° C. |
|---|---|---|---|---|---|
| C1 | 0 | 0 | 0 | −6.3 | −6 |
| C2 | 250 | 0 | 0 | −7.8 | −8 |
| C3 | 500 | 0 | 0 | −8.4 | −9 |
| C4 | 1500 | 0 | 0 | −9.0 | −10 |
| C5 | 0 | 500 | 0 | −7.5 | −8 |
| C6 | 0 | 1500 | 0 | −7.4 | −8 |
| C7 | 0 | 2000 | 0 | −7.8 | −9 |
| 1 | 165 | 335 | 0 | −7.8, −8.1[a] | −8, −9[a] |
| 2 | 330 | 670 | 0 | −8.4, −8.4[a] | −9, −10[a] |
| 3 | 660 | 1340 | 0 | −8.7 | −11 |
| 4 | 250 | 250 | 0 | −8.4 | −9 |
| 5 | 500 | 500 | 0 | −8.3 | −9 |
| 6 | 600 | 1400 | 0 | −8.8 | −10 |
| 7 | 1500 | 1500 | 0 | −9.0 | −11 |
| 8 | 335 | 165 | 0 | −8.1 | −9 |
| 9 | 670 | 330 | 0 | −8.4 | −10 |
| 10 | 750 | 250 | 0 | −9.0 | −10 |
| 11 | 250 | 250 | b, 250 | −7.8 | −9 |
| 12 | 500 | 500 | b, 500 | −8.1 | −9 |
| 13 | 1000 | 1000 | b, 1000 | −9.1 | −11 |
| 14 | 300 | 500 | b, 1200 | −9.5 | −9 |
| 15 | 325 | 325 | b, 100 | −7.8 | −9 |
| 16 | 650 | 650 | b, 300 | −8.4 | −10 |

TABLE I-continued

| Example | Fumarate copolymer, ppm | Acylated alkanol-amine, ppm | Other, ppm | Cloud point, ° C. | Minimum LTFT pass, ° C. |
|---|---|---|---|---|---|
| 17 | 865 | 865 | b, 270 | −6.8 | −8 |
| 18 | 500[c] | 250 | b, 250 | −8.1 | −8 |
| 19 | 300 | 1200 | d, 500 | −9.0 | −11 |

[a]multiple runs
[b]ethylene-vinyl acetate polymer, 50% polymer in diluent
[c]equal parts material with $C_{12-22}$ alkyl groups and $C_{12-18}$ alkyl groups
[d]couples alkyl phenol/formaldehyde pour point depressant having $C_{22-32}$ side chains Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of " permits the inclusion of substances which do not materially affect the basic and novel characteristics of the composition under consideration.

What is claimed is:

1. A wax-containing liquid composition comprising:

(a) a wax-containing liquid which exhibits diminished flow properties at low temperatures; and (b) an amount, sufficient to improve the low temperature flow properties of said wax-containing liquid, of a composition comprising (i) a copolymer of alkyl fumarate with styrene, wherein the alkyl groups of alkyl fumarate contain on average about 8 to about 30 carbon atoms; and (ii) the reaction product of an alkanolamine with a hydrocarbyl-substituted acylating agent, wherein the hydrocarbyl group is substantially linear and contains on average about 8 to about 50 carbon atoms.

2. The composition of claim 1 wherein the polymer further comprises methyl methacrylate monomer moieties.

3. A wax-containing liquid composition comprising:

(a) a wax-containing liquid which exhibits diminished flow properties at low temperatures; and (b) an amount, sufficient to improve the low temperature flow properties of said wax-containing liquid, of a composition comprising (i) a copolymer comprising at least one monomer of at least one alkyl ester of an ethylenically unsaturated 1,2-diacid, wherein the alkyl groups of said ester contain on average about 8 to about 30 carbon atoms;

(ii) the reaction product of an alkanolamine with a hydrocarbyl-substituted acylating agent, wherein the hydrocarbyl group is substantially linear and contains on average about 8 to about 50 carbon atoms; and (d) the reaction product of (i) a hydrocarbyl-substituted aromatic hydroxy compound having a number average of at least about 12 carbon atoms in the hydrocarbyl substituent, and (ii) an aldehyde of 1 to about 12 carbon atoms, or a source therefor.

4. The composition of claim 3 wherein the alkanolamine component of (ii) is diethanolamine.

5. The composition of claim 3 wherein the acylating agent of component (ii) is a hydrocarbyl-substituted succinic acid or a reactive equivalent thereof.

6. The composition of claim 5 wherein the hydrocarbyl group of b (ii) is an aliphatic hydrocarbyl group containing on average about 16 to about 24 carbon atoms.

7. The composition of claim 3 wherein the reaction product of b (ii) contains an amide, imide, or ester group.

8. The composition of claim 5 wherein the mole ratio of succinic acid functionality to nitrogen atoms in component b (ii) is about 1:2 to about 4:1.

9. The composition of claim 3 wherein components (i) and b (ii) are present in the ratio of about 1:10 to about 10:1 by weight.

10. The composition of claim 9 wherein the components (i) and b (ii) are present in the ratio of about 1:4 to about 4:1 by weight.

11. The composition of claim 3 wherein the amount of component (b) in the composition is about 5 to about 10,000 parts per million by weight.

12. The composition of claim 3 wherein the amount of component (b) in the composition is about 25 to about 2000 parts per million by weight.

13. The composition of claim 3 further comprising (c) a copolymer of ethylene and vinyl acetate.

14. The composition of claim 13 wherein the amount of component (c) is about 5 to about 2000 parts per million by weight.

15. The composition of claim 3 wherein the aromatic hydroxy compound is a monohydroxybenzene, the hydrocarbyl substituent comprises a mixture of alkyl substituents having predominantly 16–28 carbon atoms, and the aldehyde is formaldehyde.

16. The composition of claim 3 wherein the amount of component (d) is about 5 to about 1000 parts per million.

17. The composition of claim 3 wherein the wax-containing liquid of (a) is a crude oil or a petroleum stream derived from crude oil.

18. The composition of claim 1 wherein the wax-containing liquid of (a) is a diesel fuel.

19. The composition of claim 1 wherein the wax-containing liquid of (a) is a middle distillate fuel.

20. The composition of claim 19 wherein said middle distillate fuel exhibits a cloud point in the absence of component (b) of at least −40° C. as measured by ASTM D2500.

21. The composition of claim 20 wherein the amount of component (b) is sufficient to reduce the cloud point by at least 0.5° C.

22. The composition of claim 20 wherein the amount of component (b) is sufficient to reduce the cloud point by at least about 1° C.

23. The composition of claim 1 wherein the amount of component (b) is sufficient to improve the low temperature flow by at least 0.5° C. as measured by ASTM D4539-91.

24. The composition of claim 1 wherein the amount of component (b) is sufficient to improve the low temperature flow by at least 1° C. as measured by ASTM D4539-91.

25. A composition prepared by admixing the components of claim 1.

26. The composition of claim 3 further comprising (c) a copolymer of ethylene and vinyl acetate.

* * * * *